United States Patent [19]

Takahashi

[11] Patent Number: 4,733,509

[45] Date of Patent: Mar. 29, 1988

[54] MOVABLE PARTITION SYSTEM FOR CLEAN ROOM

[75] Inventor: Yoshihiko Takahashi, Komatsu, Japan

[73] Assignee: Comany Co., Ltd., Ishikawa, Japan

[21] Appl. No.: 32,457

[22] PCT Filed: Jun. 21, 1985

[86] PCT No.: PCT/JP85/00353

§ 371 Date: Feb. 19, 1987

§ 102(e) Date: Feb. 19, 1987

[87] PCT Pub. No.: WO86/07619

PCT Pub. Date: Dec. 31, 1986

[51] Int. Cl.[4] ..... F04B 5/58

[52] U.S. Cl. ..... 52/126.5; 52/238.1; 52/280; 52/283; 52/483

[58] Field of Search ..... 52/126.5–126.7, 52/79.1, 79.2, 79.9, 79.12, 238.1, 239–243, 243.1, 280–284, 483

[56] References Cited

U.S. PATENT DOCUMENTS

| | | | |
|---|---|---|---|
| 3,014,564 | 12/1961 | Thompson | 52/126.5 |
| 3,251,163 | 5/1966 | Russell | 52/282 |
| 3,279,132 | 10/1966 | Slayter | 52/73 |
| 3,350,828 | 11/1967 | Russell | 52/281 |
| 3,503,166 | 3/1970 | Nakazawa et al. | 52/241 |
| 3,628,299 | 12/1971 | Nakazawa | 52/488 |
| 3,638,387 | 2/1972 | Lickliter et al. | 52/741 |
| 3,733,759 | 5/1973 | Schulte et al. | 52/122 |
| 4,163,350 | 8/1979 | Doguchi et al. | 52/403 |
| 4,608,066 | 8/1986 | Cadwell | 55/385 A |

FOREIGN PATENT DOCUMENTS

| | | | |
|---|---|---|---|
| 1336293 | 12/1963 | France | 52/282 |
| 734809 | 8/1955 | United Kingdom | 52/281 |
| 1004141 | 9/1965 | United Kingdom | 52/483 |

*Primary Examiner*—John E. Murtagh
*Assistant Examiner*—Andrew Joseph Rudy
*Attorney, Agent, or Firm*—Kane, Dalsimer, Sullivan, Kurcz, Levy, Eisele and Richard

[57] ABSTRACT

A ceiling system bar (1) is fixed to a hanging bolt (17), which is set firmly on a steel frame base, in such a manner that an opened portion of the ceiling system bar (1) is directed downward. The hook frames (22) of ceiling panels (21) are engaged via air-tight members with F-shaped frame projections (6) which are provided on both lower side portions of the ceiling system bar (1). Panel holders (30) are provided so as to extend over the opposed portions of the ceiling panels (21) and ceiling system bar (1) to thereby join the ceiling panels (21) to the ceiling system bar (1). A floor system bar (40) is provided on a floor, which is opposed to the ceiling system bar (1), in such a manner that an opened portion of the floor system bar (40) is directed upward. In order to provide partitions (47) between the ceiling system bar (1) and floor system bar (40), the upper end portion of the partitions (47) is inserted into the opened portion of the ceiling system bar (1) via a ceiling frame (35), and the lower end portion thereof into the opened portion of the floor system bar (40). When these partitions (47) are not provided, a ceiling cover is set on the opened portion of the ceiling system bar (1), and a floor cover on the opened portion of the floor system bar (40). An illuminator can be provided in the opened portion of the ceiling system bar (1) via the ceiling frame (35).

1 Claim, 16 Drawing Figures

MOVABLE PARTITION SYSTEM FOR CLEAN ROOM

DESCRIPTION

1. Technical Field

This invention relates to the installation of ceilings, floors and partition walls in a movable partition system, and more particularly to a movable partition system for clean rooms which allows the volume of a room to be changed and which provides for improved utilization of the space above a ceiling.

2. Background Art

To date, clean rooms which are utilized in hospitals or factories, have had a form of construction in which a partitioned room is bounded by a ceiling, a floor and partition walls having no irregularity or gaps in order to prevent bacteria or dust from clinging thereto and to facilitate the cleaning of the inner surfaces of the room. The prior art has effected certain problems and there has been a demand for improvement in several aspects, as described below.

The ceiling of this type of clean room has a uniformly flat ceiling surface (that is, the lower surface of the ceiling; hereinafter referred to with this meaning) which is constituted by ceiling panels having smooth surfaces which are disposed close to each other without any gap between adjacent panels, thereby covering the entire area of the ceiling. However, these panels are secured by nails, screws or frames, so that the ability to maintain the cleanliness is apparently reduced due to corrosion of th heads of screws and the like or the irregularities formed by the same. On the other hand, on the reverse surface of the ceiling (that is, the upper surface of the ceiling; hereinafter referred to with this meaning), the ceiling panels are fixed to stiffeners which are secured to hanger bolts suspended from beams or the like, thus being in a so-called suspended state. It is considered to be dangerous for a person to step on these ceiling panels (to allow his body weight to bear on them). At the same time, there is often a need for work associated with the installation of certain equipment to be facilitated, for instance, wiring and piping for a newly installed machine, and there are certain types of equipment which are more suitably installed on the reverse surface of the ceiling than in the room. Therefore, a type of ceiling panel is needed which is capable of bearing the weight of workers, machines and equipment, and of withstanding the vibrations caused during installation work while workers are working on the ceiling in an ordinary manner rather than walking with extremely care.

It is also required that a strong ceiling panel device, which might satisfy these requirements, is able to provide a sufficient space for work of the above-described kinds to be carried out. A system in which hanger bolts are disposed at small intervals is unsatisfactory in this regard. Furthermore, it is preferable to adopt a type of hanger bolt which can be moved both vertically and horizontally in position, since even when they are few in number it is important that they are not positioned in places where equipment may be installed or workers will be working.

It goes without saying that it is primarily necessary in a clean room system to maintain cleanliness: specifically it must be air-tight, free from any risk of contamination, and capable of being cleaned easily and perfectly.

A ceiling panel in a movable partition system which satisfies these requirements is extremely heavy and the size of this type of panel in the form generally employed is large (e.g., 1000 mm×2000 mm). As an ideal solution, therefore, there has been a demand for improvements in the stability of this type of panel when mounted, as well as in the degree of safety and ease with which the installation work may be carried out.

It is common to stress the need for good lighting systems in clean rooms, but the cleanliness of the ceiling surface has always been regarded as a primary factor, and the installation of lighting fixtures tends to be a secondary concern, often resulting in the formation of undesirable projections on the ceiling.

A further requirement is to allow for rearrangement of the space within a clean room by installing partition walls incorporating certain equipment or machines such as lifesaving apparatus, TV systems, air cleaners, or incorporating electrical wiring and pipings, or to partition a large room into two or more, and this sort of requirement may include the need to remove previously installed partition walls. For this reason, the provision of channels in the ceiling or floor is needed, but extra installations of this kind run counter to the prime function of clean rooms. Partition systems for use in clean rooms have not to date been effectively improved.

The present invention has been accomplished with a view to satisfying these requirements in clean rooms, and an object of the present invention is to provide a movable partition system free from the defects of the prior art.

DISCLOSURE OF THE INVENTION

To this end, the present invention provides a movable partition system which is improved in strength and workability to maximize the potential for utilization of the space above the ceiling as well as on the space within the room, which facilitates the maintenance of cleanliness on the ceiling and floor surfaces, and which has work channels formed in the ceiling into which lighting fixtures and partition walls can be set as desired, and work channels formed in the floor into which partition walls which can also kept clean may be set.

The system in accordance with the present invention is provided with: frames for fixing ceiling panels each of which is constituted by connecting, e.g., two large steel members back to back to form a longitudinal frame member of the fixing frame such as a beam (steel backing) and by adapting a frame member made of soft metal such as aluminium to form a transversal frame member for securing this longitudinal frame member; ceiling system bars made of steel having a uniform rectangular cross-sectional shape and suspended from the steel backing such as to be slidable in the vertical directions and horizontal directions to the left or right (or to the front or rear; hereinafter referred to in this way), the ceiling system bar also having at its opposite sides F-shaped frame projections for hooking connection to which is attached airtight parts; strong ceiling panels made of steel each having a pair of hook frames each of which is constituted by hooks such as to be symmetrical in the vertical direction and each of which is formed on one of the end surfaces of the ceiling panel at which the ceiling panel is connected to the ceiling system bar, the ceiling panel being mounted in a manner such that it is slantingly lifted while one of the hook frame is being maintained in a position higher than that of the other, fitted into the accommodation frame and reset to be level, thereafter slightly moved down to be engaged with the F-shaped frame projection, and finally fixed by fitting a panel holder from the space above the reverse surface of the ceiling, thereby strengthening the reverse surface of the ceiling to facilitate work carried out thereon while forming a flat surface of the ceiling without any projection by aligning the surface of the ceiling panel with that of a ceiling cover fitted and fixed to the downward facing opening of the ceiling system bar; and floor system bars in the floor disposed and embedded parallel in the longitudinal direction such as to face the ceiling system bars, tthe surfaces of the floor and a floor cover fitted and fixed to an upward facing opening of the floor system bar being aligned with each other to form one uniform surface without any projection. The ceiling cover fitted and fixed to the ceiling system bar together with the floor cover fitted and fixed to the floor system bar may be removed to form channels facing each other, and a partition wall or the like may be installed in these channels without forming any gap. In the system in accordance with the present invention, components are connected and fixed in the manner of fitting or engagement without using any nail, screw or other projecting fixture for connecting the components.

BEST MODE FOR CARRYING OUT THE INVENTION

The present invention will be described hereinafter in detail with reference to the accompanying drawings.

Figure 1:
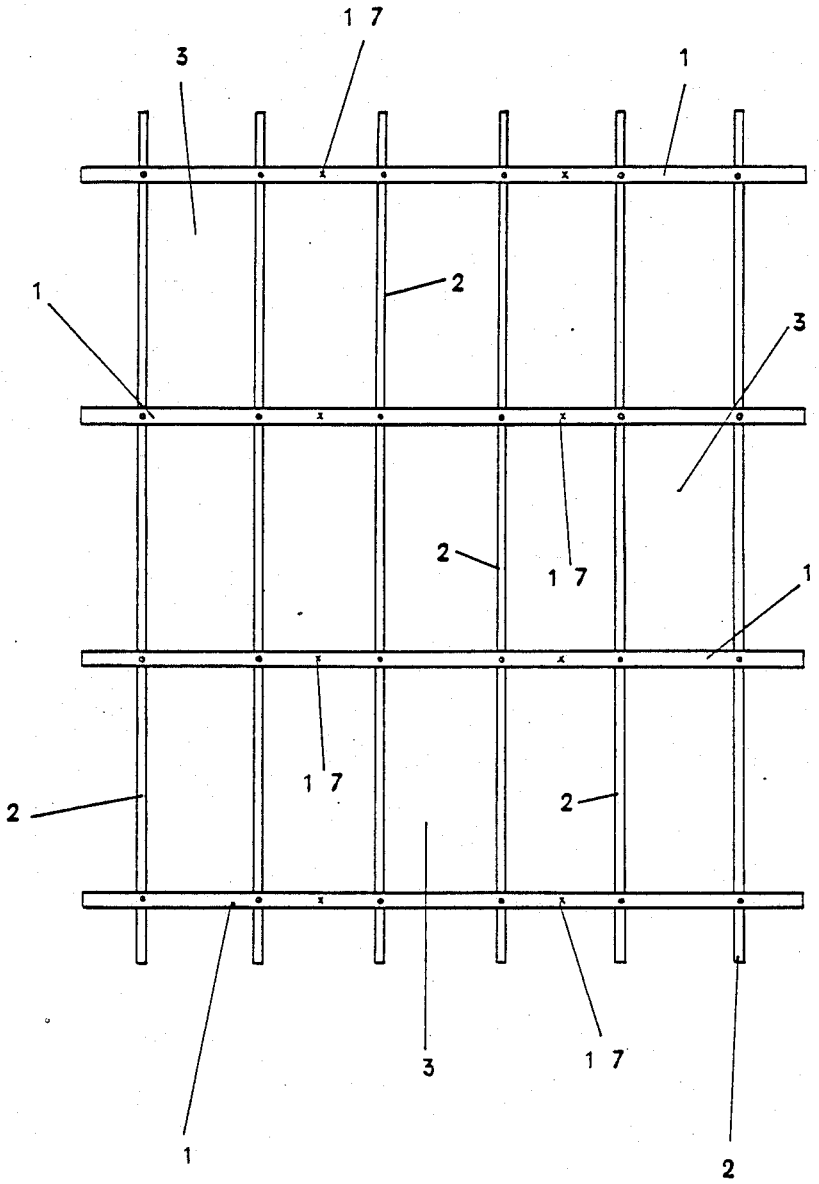
FIG. 1 is a plan view of accommodation frames 3 in a ceiling device in accordance with one embodiment of the present invention.

FIG. 1 shows in plan accommodation frames 3 which are constituted by ceiling system bars 1 and aluminium members 2 and which form a part of a ceiling device in a group of ceiling, floor and partition systems in accordance with the present invention.

As shown in FIG. 1, in a preferable form of the accommodation frames 3, the interval of the ceiling system bars 1 is adjusted to the length of the longer side of a ceiling panel 21, and the interval of the aluminium members 2 is adjusted to the length of the shorter side of the ceiling panel 21.

Figure 3:
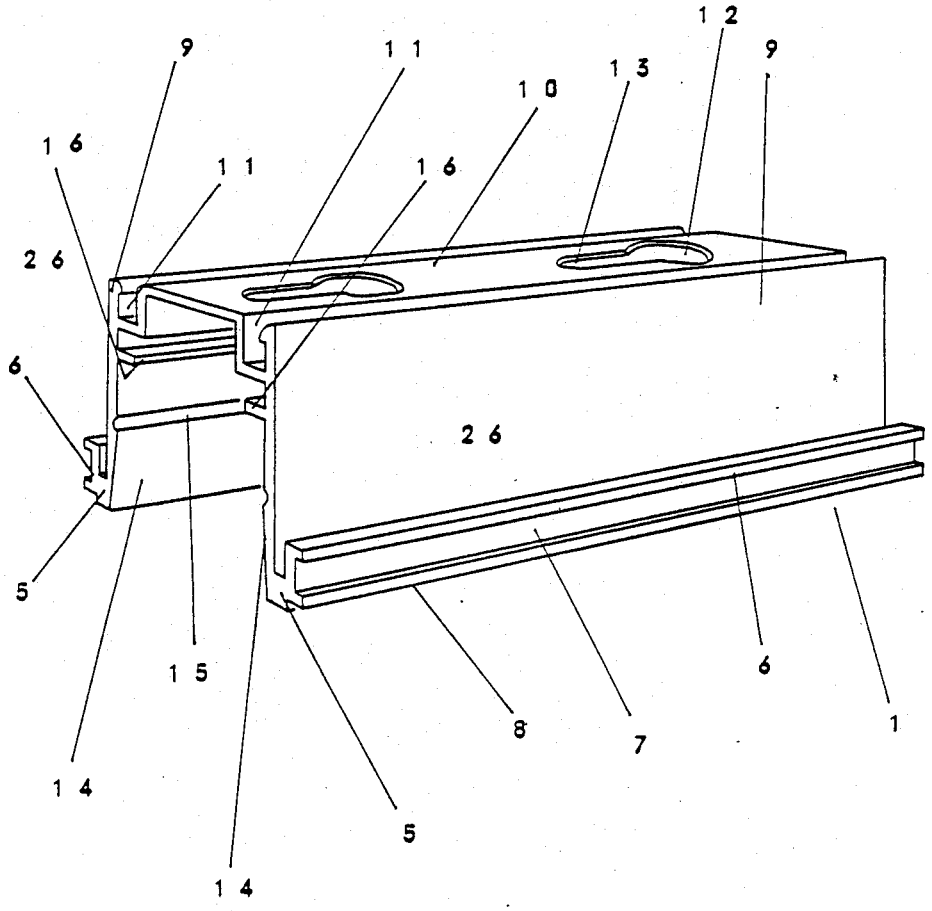
FIG. 3 is a perspective view of a ceiling system bar 1 in the same ceiling device.

The ceiling system bar shown in FIG. 3 is a strong, elongated member having a generally square cross-sectional shape. It has a hollow inner space opened at the bottom, support projections 5 outwardly extending to a small extent from the opening edges of opposite side wall portions in the direction perpendicular thereto over the entire length of the bar, and F-shaped frame projections 6 which have an F-shaped cross-sectional configuration in a rectangular form with a short leg portion and which are formed at the outer ends of the support projections 5 and extend therefrom perpendicularly such as to form a symmetrical arrangement over the entire length to the bar. Each F-shaped projection 6 has an A recess 7 that faces outwardly and is formed in a position corresponding to the upper portion of the F-shaped configuration, as well as a B recess 8 formed under the A recess 7. The opposite side wall portions of the ceiling system bar 1 are vertically extended at their upper ends to a small extent to form elongated engaging walls 9, and the upper wall portion of the bar is upwardly raised to a level corresponding to the height of the upper edges of the engaging walls 9, thereby forming upper raised portion 10 which constitutes a projection in the form of an elongated box, together with rectangular fitting channels 11 between the engaging walls 9 and the upper raised portion 10. A plurality of large apertures 12 and elongated apertures 13 that are continuously formed with the large apertures 12 are formed in the upper raised portion 10. The inside edges of the downward facing opening of the ceiling system bar 1 and a part of the inner wall portion near these edges are slantingly cut and removed to a small extent in the widthwise direction over the entire length of the bar, thereby forming slanted walls 14. The inner surface portion is also cut inside the slanted walls surfaces in the lengthwise direction of the bar to form semi-circular grooves 15 having a semi-circular cross-sectional shape. Frame receiving portions 16 are formed at further inner positions on the inner surface of the bar such as to extend therefrom inwardly and perpendicularly to a small extent. The slanted walls surfaces 14 are provided for the purpose of facilitating the fixing of a member (described later) which might be fitted into the inner space of the bar.

Figure 2:
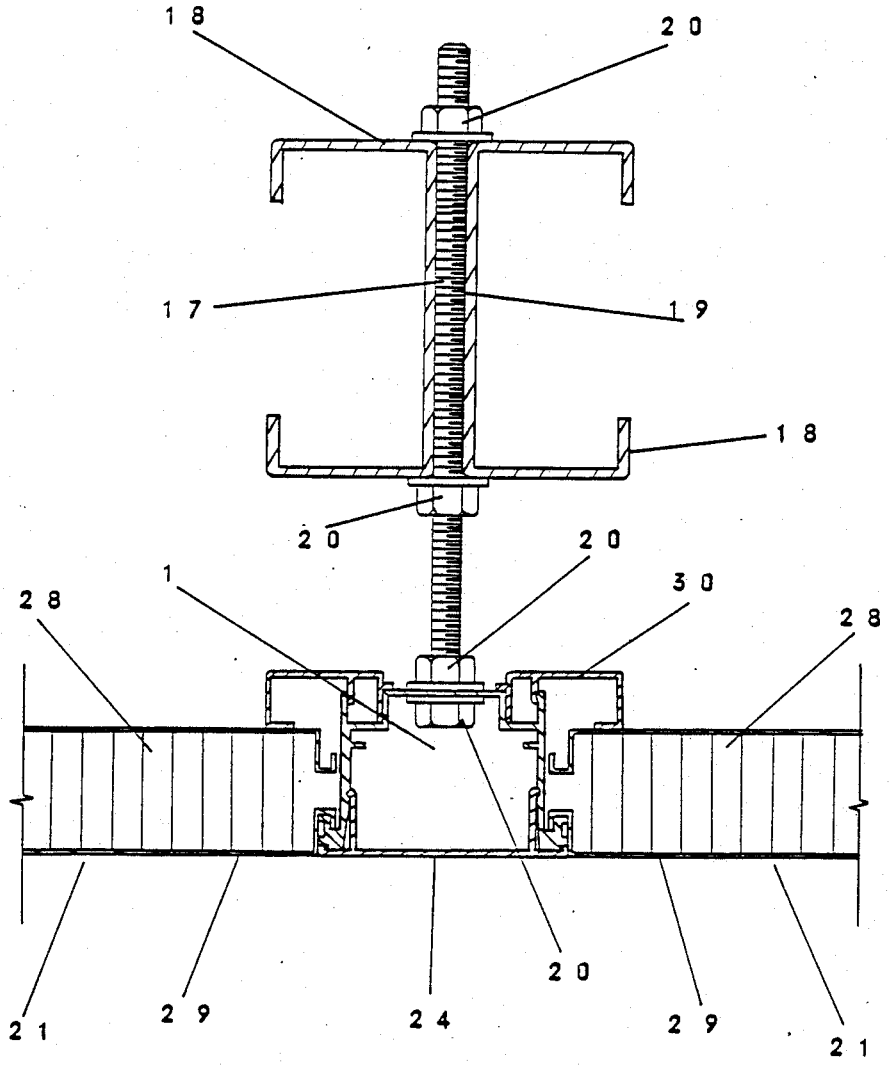
FIG. 2 is a cross-sectional view of the same ceiling device.

As shown in FIG. 2, in the ceiling device in accordance with the present invention, the ceiling system bars 1 are suspended by being fixed to the bolts 17 which pass through slide slits 19 of the beams or steel backing 18 and which are secured to the steel backing 18 by means of nuts 20. Each ceiling panel 21 is mounted in the ceiling system bar in such a manner that hook frames 22 formed on the opposite end surfaces are fittingly engaged with the F-shaped frame projections 6 of the ceiling system bar 1 with airtight members 23 interposed therebetween in the A recess 7 and the B recess 8 without leaving any gap therebetween. Ceiling covers 24 are fitted into the downward facing opening of the ceiling system bar 1 over the entire area thereof.

Figure 4:
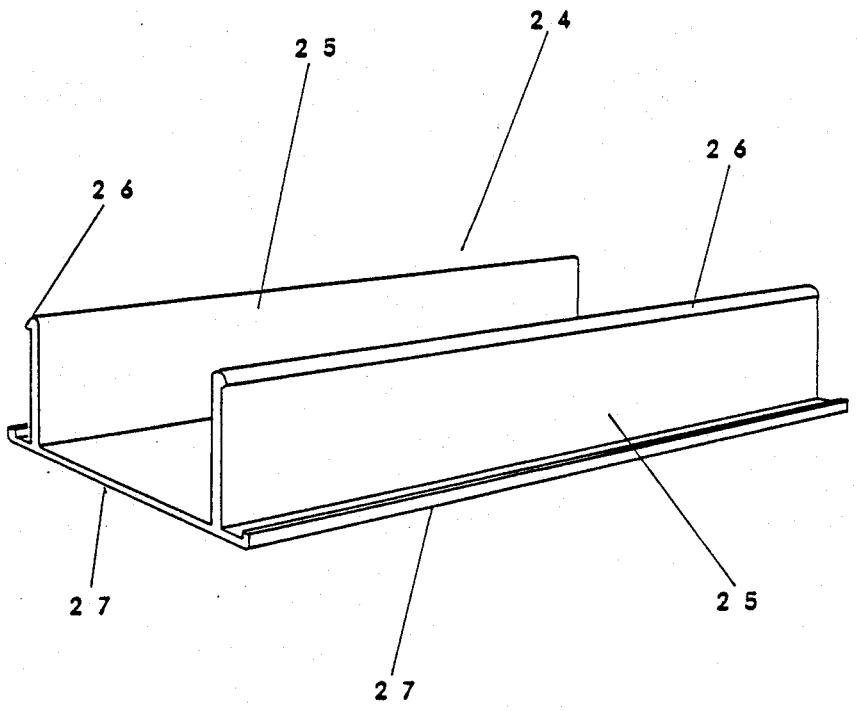
FIG. 4 is a perspective view of a ceiling cover 24 in the same ceiling device.

The components of the ceiling device apart from the ceiling system bar 1 will now be described in detail. FIG. 4 shows the ceiling cover 24 which is an elongated frame member made of metal having a generally U-shaped cross-sectional configuration. The ceiling cover 24 has left and right insertion extensions 25 which are inserted into the opening of the ceiling system bar and fitted to the opposite inner surfaces thereof. Each insertion extension 25 has an elongated semi-circular protrusion 26 having a semi-circular cross-sectional shape and outwardly projecting from the outer surface of the extension 25 at the free end of the same. The semi-circular protrusion 26 is designed to outwardly contact the above-described semi-circular groove 15 of the ceiling system bar 1. An elongated decorative surface 27 is formed in such a manner that the portion of the ceiling cover 24 corresponding to the bottom side of the U-shaped sectional configuration is outwardly and perpendicularly extended to the left and right. The width of the decorative surface 27 corresponds to the distance between outer surfaces of the left and right F-shaped frame projections 6 of the ceiling system bar 1, namely, the distance between the side edges of each ceiling panel 21, as shown in FIG. 2.

Figure 5:
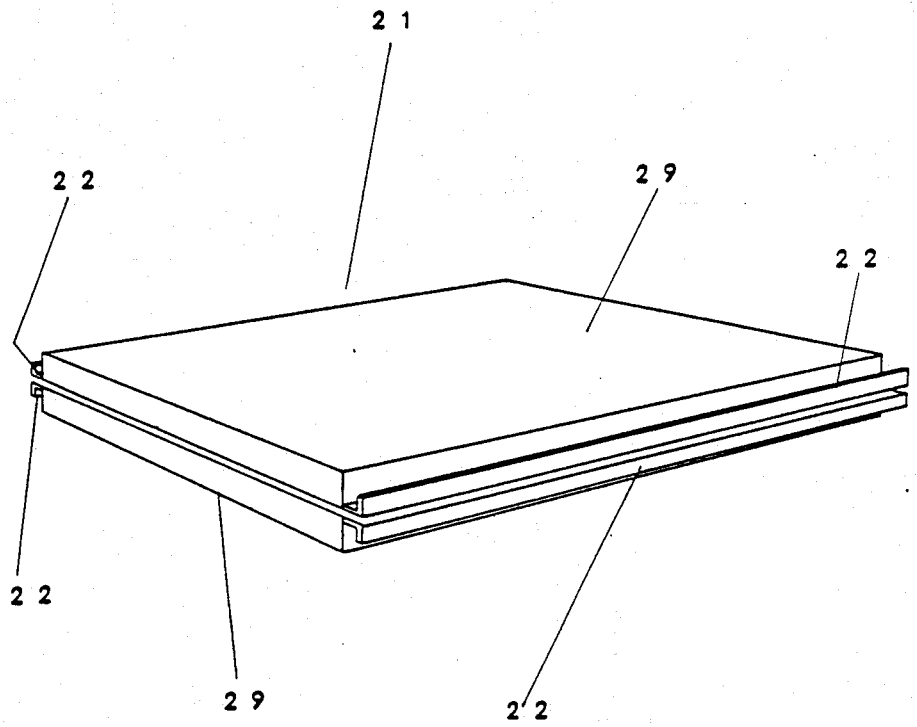
FIG. 5 is a perspective view of a ceiling panel 21 in the same ceiling device.
Figure 8:
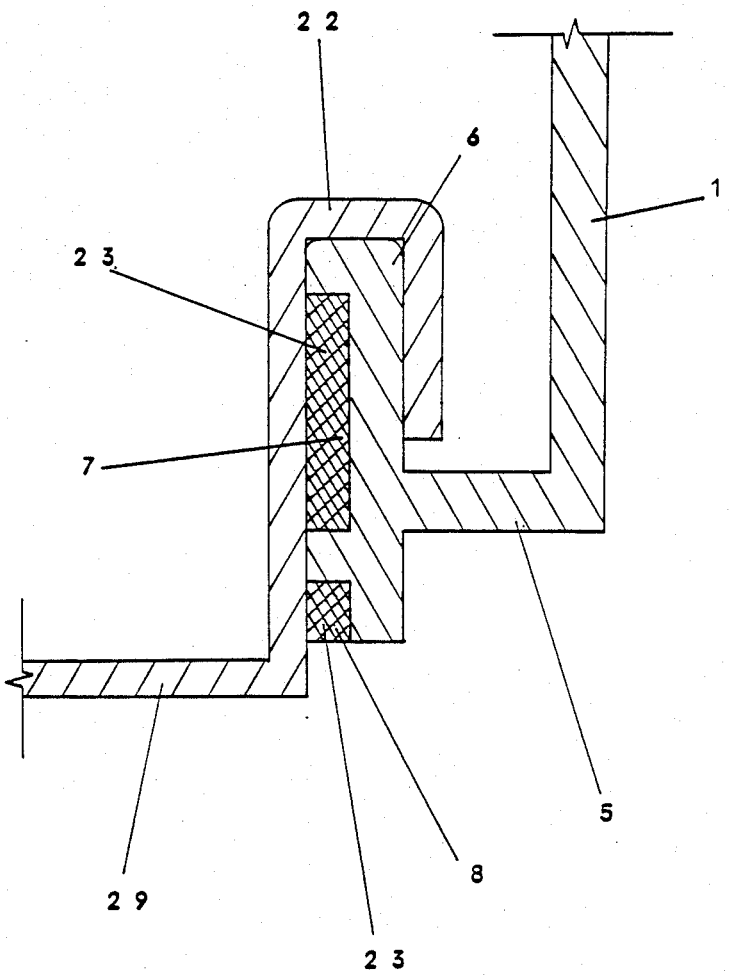
FIG. 8 is a partially cut-away enlarged cross-sectional view illustrating the state of an F-shaped frame projection 6 and a hook frame 22 being connected with each other in the same ceiling device.

FIG. 5 shows one of the ceiling panels 21. Each ceiling panel 21 is encircled by steel plates, charged with reinforcement members and a heat insulating or sound insulating material 28, and provided with hook frames 22 which have the full width of the panel and are symmetrical in the vertical direction, as shown in FIG. 5, and which are formed at the end surfaces at which the panel contact the ceiling system bars 1. Each hook frame 22 is formed by bending along the end surface of a steel plate, which forms one surface 29 of the panel, such as to form a rectangular hook-like cross-sectional configuration. This is engaged with and fixed to the above-described F-shaped frame projection 6 without leaving any gap therebetween, as shown in FIG. 8 while positioning the surface of the panel 29 and the decorative surface 27 in alignment with each other. One of the pair of hook frames 22 which is not engaged with the F-shape frame projection is brought into contact with the ceiling system bar 1 so as to act as a reinforcement member.

Figure 6:
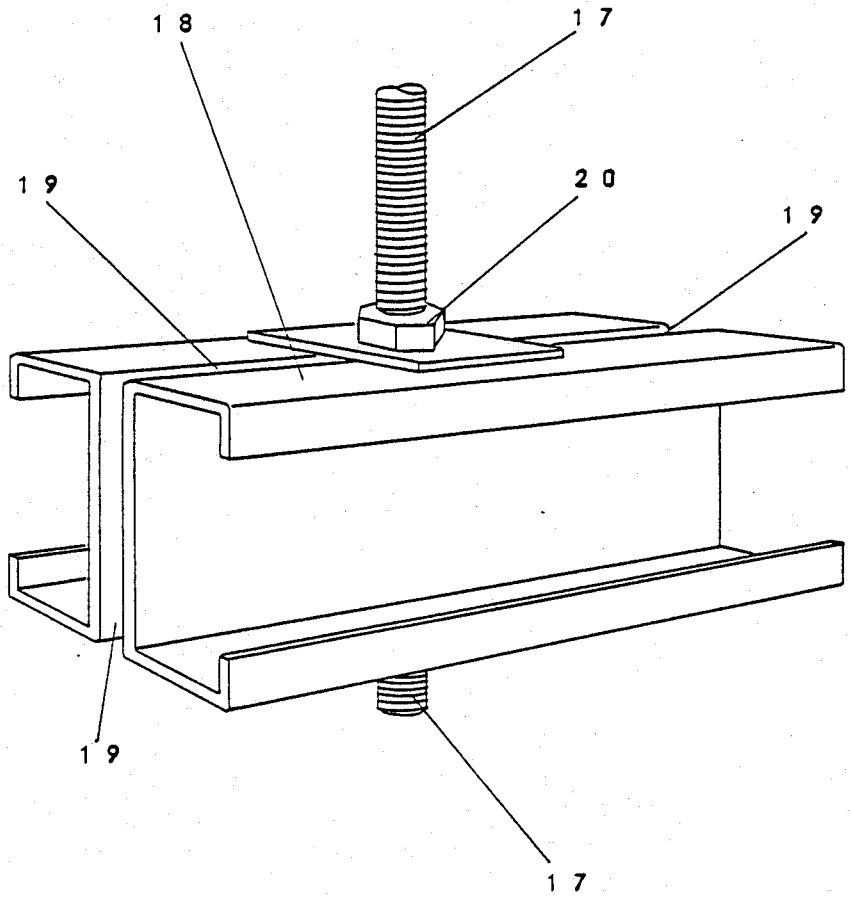
FIG. 6 is a perspective view illustrating the relationship between a hanger bolt 17 and a steel backing 18 in the same ceiling device.

FIG. 6 shows part of the steel backing 18 and one of the hanger bolts 17. The steel backing 18 is integrally formed by partially connecting two large elongated lip channel members back to back with a gap left therebetween, the thickness of the gap corresponding to the diameter of the hanger bolt 17. This gap forms the slide slit 19 such as to be open through the center of the steel backing and to have a width equal to the diameter of the hanger bolt 17.

The hanger bolt 17 is a large steel bolt threaded partially or entirely and capable of fitting into the nut 20.

Figure 7:
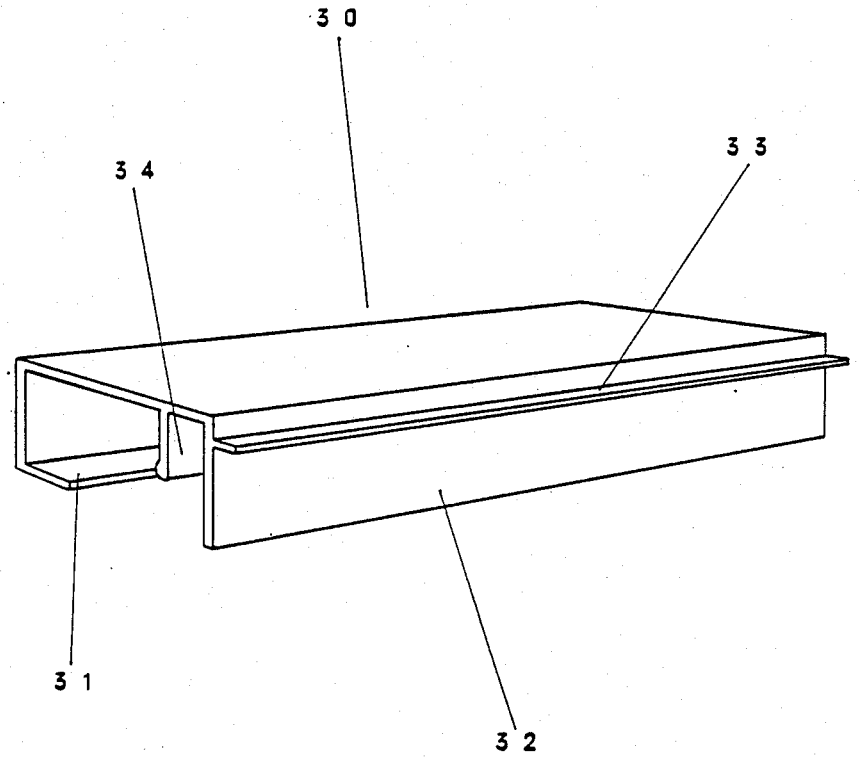
FIG. 7 is a perspective view of a panel holder 30 in the same ceiling device.

FIG. 7 shows a panel holder. A panel holder 30 is an elongated metal member being of U-shaped cross-sectional configuration and having a narrow panel holding extention 31 which is formed by bending the free end of one of the side wall portions, inwardly and perpendicularly, an A fitting extention 32 which is the other side wall portion, and an upper holding extention 33 which outwardly projects perpendicularly from the outer surface of the A fitting extention 32 to a small extent at a position spaced apart from the free end of this fitting extention and at a distance corresponding to the height of the above-described upper raised portion 10. The panel holder 30 also has a B fitting extention 34 which perpendicularly extends from the inner surface of the panel holder corresponding to the bottom side of the U-shaped cross-sectional configuration to a slightly smaller extent that the height of the A fitting extension 32. The A fitting extension 32 and the B fitting extension 34 are fitted into the fitting channel 11.

Figure 9:
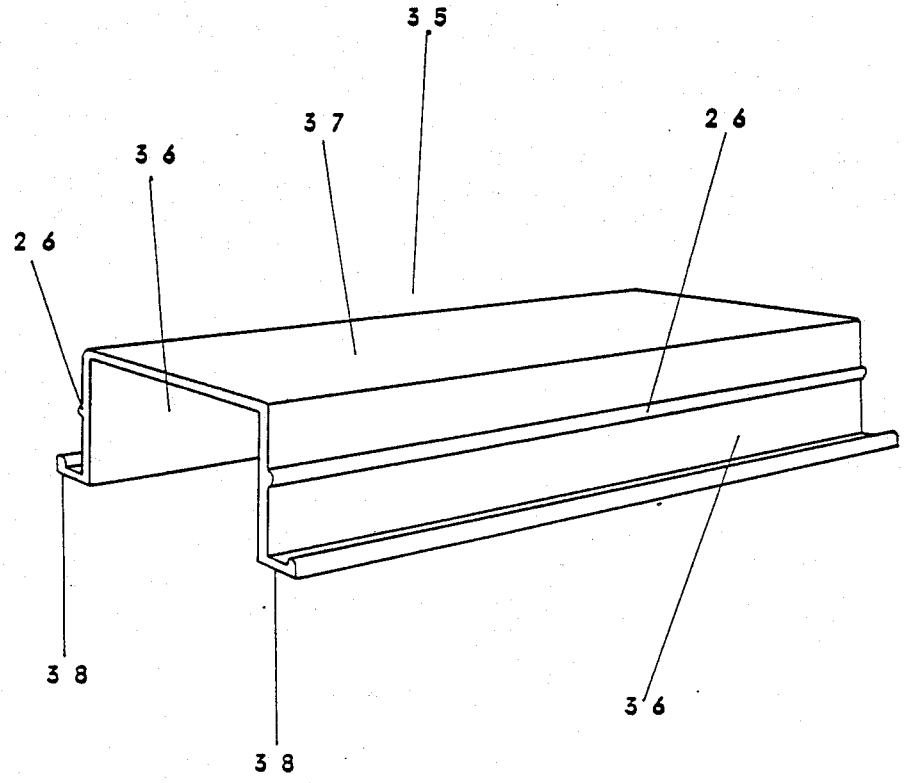
FIG. 9 is a perspective view of a ceiling frame 35 in the same ceiling device.

FIG. 9 shows a ceiling frame 35. The ceiling frame 35 is an elongated metal member having a generally U-shaped cross-sectional configuration with an opening that faces downwardly. Portions of the ceiling frame 35 which correspond to opposite sides of this configuration are formed to act as frame extensions 36. An elongated semi-circular protrusion 26 having a semi-circular cross-sectional shape is formed on the outer surface of each frame extension 36 such as to outwardly project therefrom. The elongated semi-circular protrusion 26 outwardly contacts the semi-circular groove 15 of the ceiling system bar 1 when the ceiling frame 35 is fitted into the ceiling system bar 1. The bottom frame portion 37 of the ceiling frame 35 which corresponds to the bottom side of the cross-sectional configuration contacts the frame receiving portions 16 of the ceiling system bar 1 when fitted into the ceiling system bar 1. The free end of each frame extension 36 is outwardly and perpendicularly extended to a position which corresponds to the outer surface of the F-shaped frame projection 6 of the ceiling system bar (the side end surface of the ceiling panel 21 as shown in FIG. 2) as in the fitted state of the ceiling frame 35, thereby forming joint cover extensions 38. The distance between the outer ends of the joint cover extension 38 is equal to that of the decorative surface 27, and the open front surface of each joint cover extension 38 is aligned, in the fitted state, with the panel surface 29 of the ceiling panel 21 while the reverse surface is brought into contact with the short leg portion of the F-shaped frame projection 6.

Figure 10:
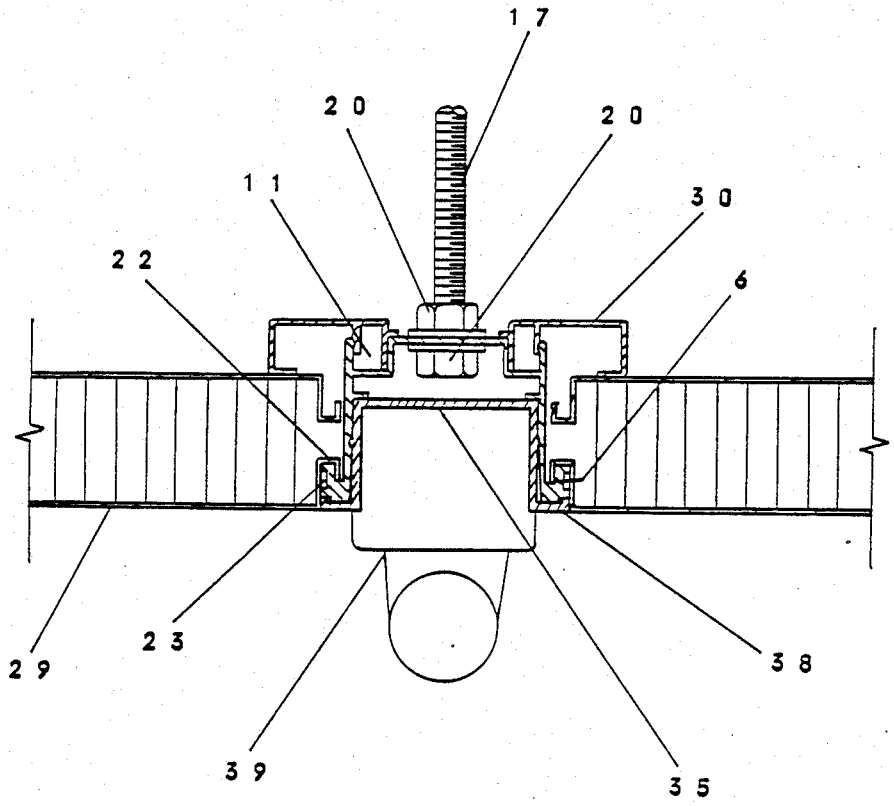
FIG. 10 is a partially cut-away cross-sectional view of the same ceiling device and a lighting fixture 39 mounted in the same.

FIG. 10 shows the fitted state of the ceiling frame 35 with a lighting fixture 39 mounted therein without leaving any gap therebetween.

Figure 11:
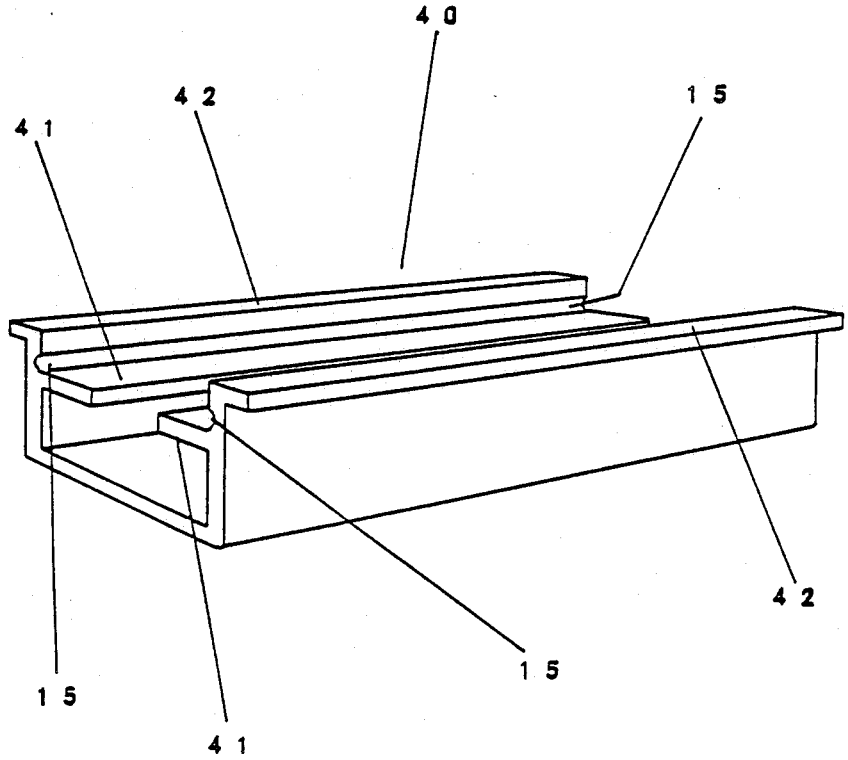
FIG. 11 is a perspective view of a floor system bar 40 of a floor device in accordance with the embodiment shown in FIGS. 1 to 10.
Figure 13:
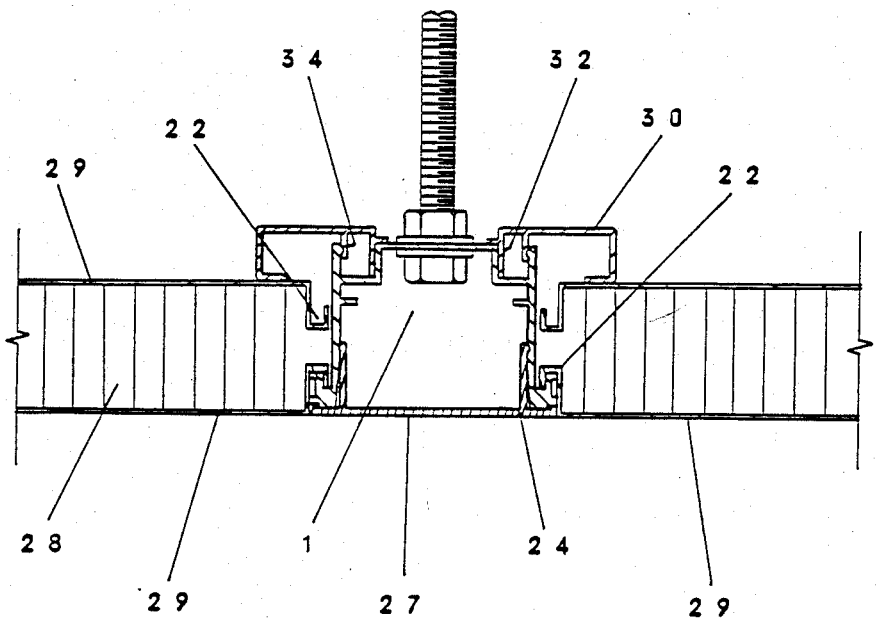
FIG. 13 is a partially cut-away cross-sectional view of portions of the same ceiling and floor devices corresponding to each other.
Figure 13:
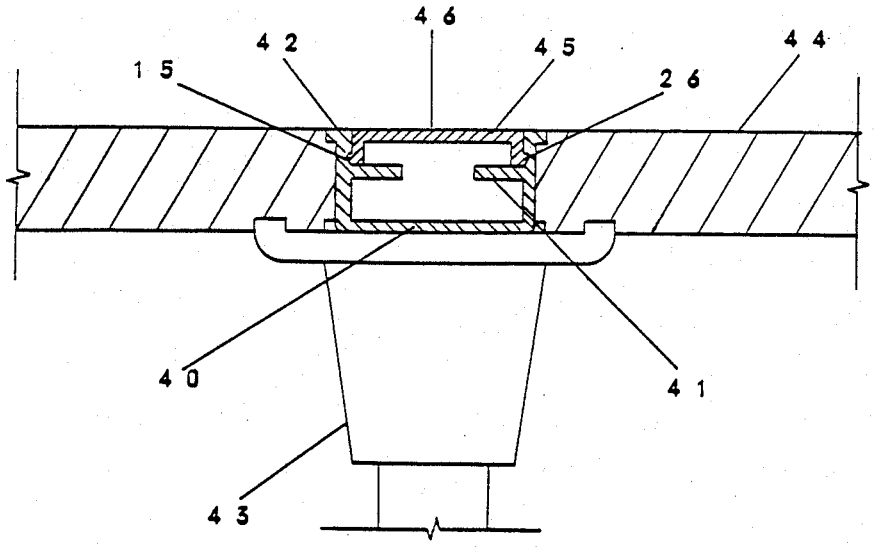
Figure 14:
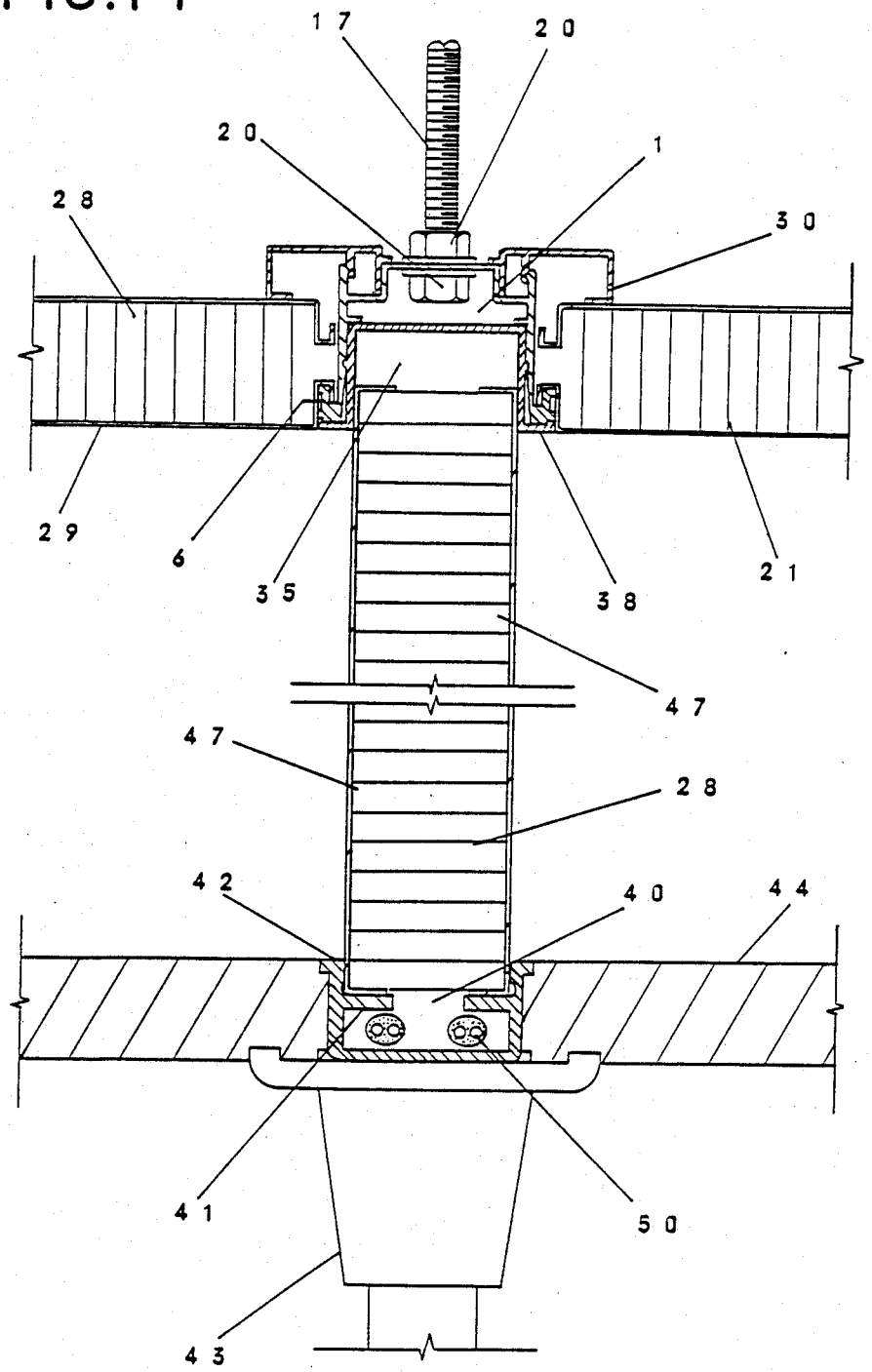
FIG. 14 is a partially cut-away cross-sectional view illustrating the relationship between the same ceiling and floor systems and a partition wall 47.
Figure 15:
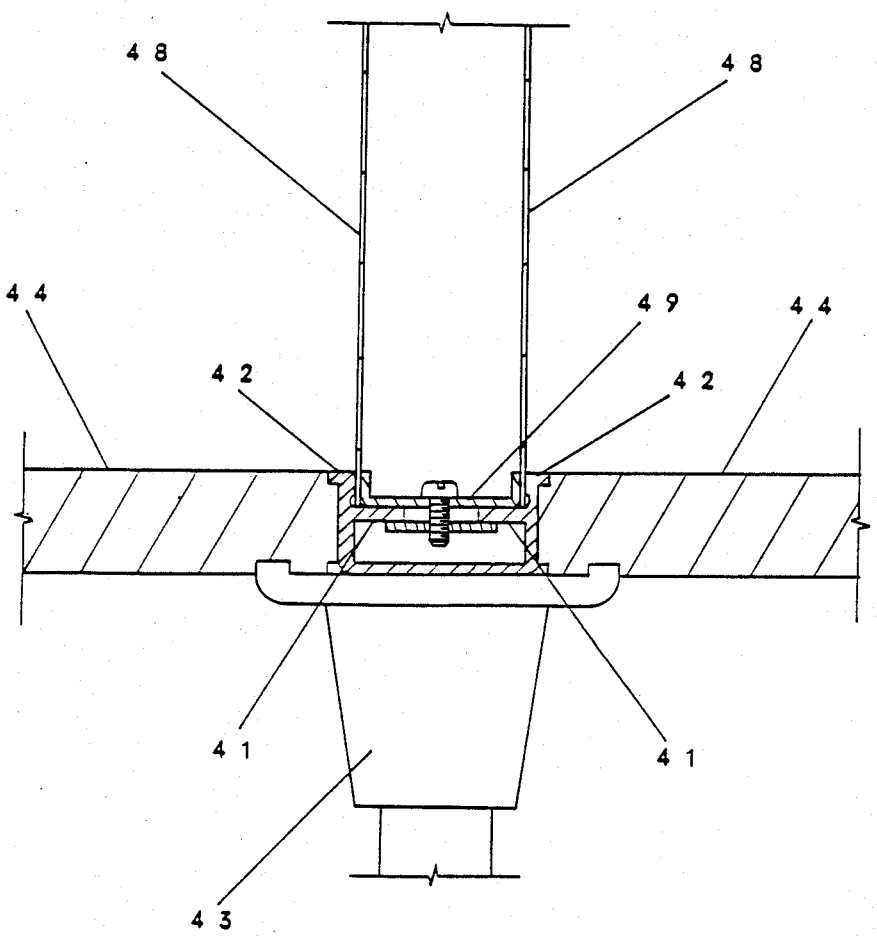
FIG. 15 is a partially cut-away cross-sectional view illustrating the relationship between a door frame 48 and the same floor device.
Figure 16:
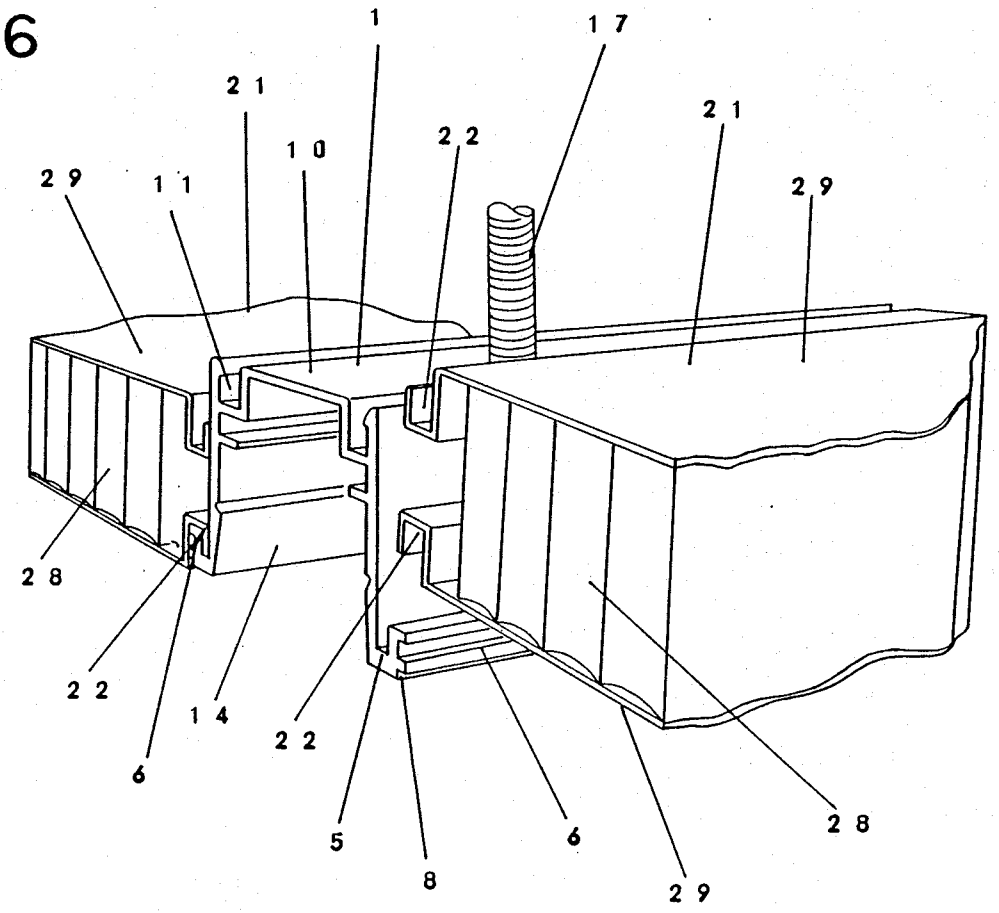
FIG. 16 is a partially cut-away perspective view illustrating the state of the ceiling panel 21 being mounted in the same ceiling device.

FIG. 11 shows a floor system bar 40 utilized in the floor device in accordance with the embodiment of the present invention. The floor system bar 40 is an elongated metal member having a generally U-shaped cross-sectional configuration with an opening that faces upwardly. The floor system bar 40 has elongated receiving projections 41 which inwardly and perpendicularly extend from the inner surfaces of the side wall portions at positions generally corresponding to the centers of the opposite sides of the U-shaped configuration to a point about one third the distance between the inner surfaces. A semi-circular groove 15 having a semi-circular cross-sectional shape is formed in the inner surface of each side wall portion of the floor system bar 40 in a position immediately above that of the receiving projection 41 over the entire length of the bar. The free end of each side wall portion of the floor system bar 40 is extended perpendicularly and outwardly, thereby forming lips 42. The depth of the floor system bar 40 is determined such that, when the floor system bar 40 is installed on a support foot 43 and embedded in the floor, the upper surface of each lip 42 is aligned with the floor surface 44. The distance between the opposite inner surfaces of the floor system bar 40 is set to be equal to that between the inner surfaces of the frame extentions 36 of the ceiling frame 35. The floor system bars 40 are positioned to face the ceiling system bars 1, as illustrated in FIGS. 13 to 15, and disposed and embedded, for instance, in series or parallel with each other and in the longitudinal direction. However, they may not necessarily be disposed in every position corresponding to the ceiling system bars 1.

Figure 12:
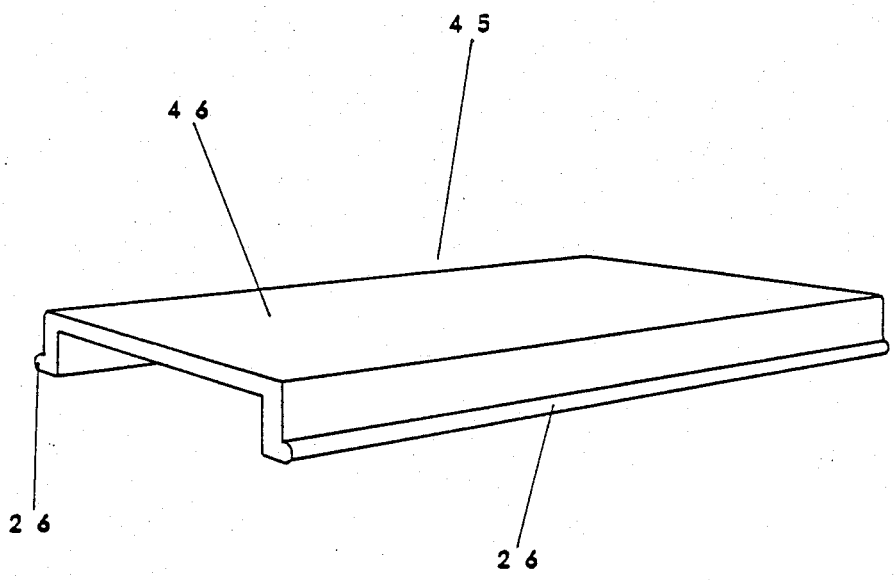
FIG. 12 is a perspective view of a floor cover 45 in the same floor device.

FIG. 12 shows a floor cover 45 in the floor device. The floor cover 45 is an elongated metal member having a generally U-shaped cross-sectional configuration with an opening that faces downwardly. The floor cover 45 has elongated semi-circular protrusions 26 having a semi-circular cross-sectional shape and formed on the outer surfaces of opposite side wall portions of the floor cover at the free ends thereof. When the floor cover 45 is fittingly inserted into the opening of the floor system bar 40, the semi-circular protrusions 26 of the opposite side wall portions outwardly contact the semi-circular grooves 15 while the free ends thereof are in contact with the receiving projections 41. In this state, the floor cover surface 46 are in alignment with the surfaces of the lips 42.

A system in accordance with the present invention is thus arranged, and the usage of the same will be described below. In the first place, in the ceiling device, the members of the steel backing 18 provided as beams are fixed after being arranged, for example, in the longitudinal direction and parallel with each other at intervals equal to the width of the ceiling panel 21 or twice as large as the same. In the arrangement shown in FIG. 1, the interval is equal to the width of the ceiling panel 21. Next, as shown in FIG. 6, the hanger bolts 17 are inserted into the slide slits 19 of the steel backing members 18 to pass through the same and are fixed by being fastened by the nuts 20 disposed on both the upper and lower sides of the steel backing members 18. At least two hanger bolts 17 are secured to one steel backing member 18 in the same manner. Furthermore, a nut 20 is set at the lower end of each hanger bolt 17, and another nut 20 is set in a position above and slightly spaced apart from that of the former.

Next, the ceiling system bars 1 are positioned beneath the backing members 18 such as to be parallel with the same. The nuts 20 set at the lower ends of the hanger bolts 17 are then passed through the large apertures 12 formed in the upper raised portions 10 of the ceiling system bars 1, slid laterally along the edges of the elongated apertures 13, and, after being positioned to set the hanger bolts 17 vertical, fastened by the other nuts which have been set thereabove at certain interval, thereby fixing the ceiling system bar 1. In this case, the distance between each steel backing member 18 and the nut 20 disposed at the lower end of each hanger bolt 17 has preliminarily been adjusted generally uniformly.

The level of each ceiling system bar 1 can be adjusted by loosening the upper and lower nuts 20 which are fastening the steel backing member 18. At the same time, the position of each hanger bolt 17 can be adjusted by being slid in the slide slit 19 in the longitudinal direction thereof. When fine adjustment is needed, the position of each hanger bolt 17 in the elongated aperture 13 of the ceiling system bar 1 or the position of each nut 20 at the lower end of the hanger bolt 20 may also be changed.

The ceiling system bars 1 are aligned at the same level under the steel backing 18, disposed, for example, in series or parallel with each other, and fixed in the above described manner. In the case of the arrangement shown in FIG. 1, the aluminum members 2 are also disposed and fixed laterally and perpendicularly relative to the ceiling system bars 1 at intervals corresponding to the width of the ceiling panel 21, thereby forming the accommodation frames 3 in the form of parallel crosses.

The aluminium members 2 are provided for the purpose of maintaining the correct distance between the ceiling system bars 1. Soft metal such as aluminium is suitable for this purpose since it enables the members to be finely adjusted. For the convenience of description, the formation of the accommodation frames 3 has been described as if it is completed in the first step as shown in FIG. 1, but in fact the aluminium members 2 are roughly attached in the first place and the formation of the accommodation frames 3 shown in FIG. 1 is completed over their entire area as the ceiling panels 21 are mounted one after another in a manner such as described below.

The air-tight material 23 is attached to the A recesses 7 and the B recesses 8 of each ceiling system bar 1 so that these recesses are fully stuffed with the material 23. This may, of course, be previously attached to them. The ceiling covers 24 are fitted into the downward facing openings of the ceiling system bars 1 along the slanted wall surfaces 14.

Next, each ceiling panel 21 is lifted slantingly from, for example, the floor to be inserted into the accommodation frame 3 between the ceiling system bar 1 while moving the hook frames 22 formed at the opposite ends of the ceiling panel 21 toward the F-shaped frame projections 6 of the ceiling system bars 1 and while maintaining one side of the panel in a position slightly higher than the other side. Then the ceiling panel 21 is moved down while being maintained to be parallel with the frame, and the hook frames 22 on the opposite side are fittingly hooked on the F-shaped frame projections 6 (FIG. 8). In this case, the contact portions of the ceiling panel 21 and the ceiling system bars 1 are mantained in contact with each other to be airtight without forming any gap therebetween, since the contact between these portions is maintained by the accurate end surfaces made of solid steel and since the airtight material 23 is interposed therebetween (FIG. 8). The panel surfaces 29 and the decorative surfaces 27 of the ceiling covers 24 are aligned with each other to form the ceiling surface, and there is no projection formed thereon (FIG. 2, FIG. 8, FIG. 13).

The ceiling can be finished to have uniformly flat surface without any gap because of the effect of the construction of each component described above and because the hanger bolts 17 and the ceiling system bars 1 are slidable in the horizontal and vertical directions so that the level adjustment or the like can be easily performed with high accuracy.

Workers then enter into the space on the reverse side of the ceiling to complete the ceiling device as described below. The panel holders 30 are placed on the ceiling system bars 1 along the F-shaped frame projections 6 thereof. The A fitting extension 32 and B fitting extension 34 are then fitted into the fitting channels 11. The panel holding extension 31 is brought into contact with the panel surface 29 of the ceiling panel. The upper holding extension 33 is pressed down to be brought into contact with the upper surface of the upper raised portion 10. The upper portions of the ceiling panel 21 and the ceiling system bar 1 are thereby combined and fixed relative to each other. The vertical movement of each of the ceiling panels 21 is thus limited, and the movement of the same to the front and the rear is also limited as they are successively hanged on the ceiling system bar 1 to be disposed closely, thus forming the ceilin surface and reverse surface of the ceiling stable and strong.

The attachment of ligting fixtures 39 will be described below. In the ceiling surface formed in the above-described manner, the ceiling cover 24 which has been fitted and fixed to the ceiling system bar 1 is stripped off and removed therefrom, and the ceiling frame 35 is mounted in the downward facing opening in place of the ceiling cover 24 with the frame extensions 36 closely fitted to the opening. In this state, the surface of the joint cover extension 38 and the panel surface 29 of the ceiling panel 21 are positioned at the same level without forming any gap therebetween. The lighting fixture 39 is mounted without forming any gap by utilizing the work channel of the ceiling frame 35.

Next, the installation of the floor device will be described. The floor system bar 40 is embedded in a position opposed to that of the ceiling system bar 1. The floor cover 45 is fitted into the floor system bar 1. In this state, the semi-circular protrusions 26 on the opposite side wall portions of the floor system cover 45 outwardly contact the semi-circular grooves 15 while the free ends of the opposite side wall portions are in contact with the upper surface of the receiving projections 41. The floor surface 44 and the floor cover surface 46 are at the same level and there is no gap therebetween. Accordingly, the floor system bar 40 thus installed does not affect the cleanliness of the floor surface 44. Also the utilization of the floor is not worsened.

The invention will be described below with respect to the partition device. A partition wall 47 has a thickness equal to the distance between the inner surfaces of the frame extensions 36 of the ceiling frame 35. The size of the partition wall 47 is determined so as to fit and stand the wall between the ceiling system bar 1 and the floor system bar 40. As described above, the ceiling frame 35 is mounted in the ceiling system bar 1, and, in the floor, the floor cover 45 which has been fitted and fixed to the floor system bar 40 is stripped off and removed therefrom. The upper end of the partition wall 47 is inserted and fitted into the ceiling frame 35, and the wall is thereafter moved down while being maintained upright until its lower end reaches the receiving projections 41, thus installing the wall. There is no gap between the partition wall 47, the ceiling frame 35 and the floor system bar 40.

When in this example a frame body such as a door frame 48 is installed, a lower attachment metal fixture 49 may be set between the receiving projections 41 as in FIG. 15, certain gaps corresponding to the thickness of the frame body being formed outside the left and right ends of metal fixture 49, thereby installing the door frame 48 in the same manner as in the case of the above-described partition wall. This arrangement is effective in some cases because the lower end portion of the door frame 48 is fitted and fixed to the gaps between the lower attachment metal fixture 49 and the lips 42.

The reverse surface of the ceiling thus obtained is extremely strong and requires no scaffolding board or catwalk. It enables a large or heavy machine or apparatus to be moved or installed thereon. Even if the ceiling panel 21 is heavy or large, it can be easily mounted since it is lifted upwardly from the floor or the like to be hung and fixed.

There is no gap in the ceiling, floor surface 44 and the partition walls at the portions where they are connected to each other without using any nails or screws. They are capable of facilitating the maintenance of cleanliness and display neat appearances.

The device realizes a high degree of adaptability enalbing the thickness of the ceiling panel 21 to be increased for the purpose of improving the strength of the panel or, reversely, to be decreased. Since the ceiling panel 21 is charged with reinforcement members and a heat insulating or sound insulating material, it is not necessary to provide an additional heat insulating system in the space formed above the reverse surface of the ceiling, thus maximizing the usable space thereon and improving the ventilation. The number of the hanger bolts 17 is remarkably reduced compared with the case of the conventional arrangement in which the hanger bolts are disposed closely, they are arranged at intervals, for example, twice as large as the width of the ceiling panel 21, as shown in FIG. 1.

The cleanliness of the floor device is as described above, and the construction of the floor device in which the floor system bar 0 is previously embedded in the floor at the same level as that of the floor surface 44 and covered with the floor cover 45 which is fitted and fixed in the bar is highly effective.

Lighting fixtures and partition systems can be mounted or installed without providing additional attachment fixtures on the ceiling and the floor surface 44 and without forming any gap after being installed.

The assembly work of the system in accordance with the present invention generally consists of fitting work, which can be carried out easily. The component parts including the ceiling panel 21 can be removed very easily by effecting the reverse process of the fitting, as exemplified in stripping off the ceiling cover 24 fitted and fixed in the ceiling systtem bar 1 on the floor cover 45 in the floor system bar 40. This work can be performed not only in the order of the arrangement of the components from the end thereof but also in any suitable order and from portions. Moreover, the ceiling and floor system bar 40 can incorporate electrical wiring 50 or other pipings.

Industrial Applicability

The present invention is not only applicable to ceiling, floor and partition device in clean rooms but also capable of realizing the effective utilizing of spaces in various fields along with the utilization of the space formed on the reverse side of the ceiling in movable partition systems.

What is claimed is:

1. A movable partition system for maintaining cleanliness and air tightness comprising a ceiling device in which a ceiling surface maintaining cleanliness and in which a reverse surface of the ceiling allows and facilitates walking and working thereon, a floor device maintaining cleanliness and a partition device and, partition wall displaying cleanliness and airtightness, wherein, (I) said ceiling device is characterized in that:

(a) steel backing members 18 provided as beams are fixed after being arranged parallel in a longitudinal direction, each of said steel backing members 18 being integrally formed by partially connecting a pair of large elongated steel lip channel members back to back with a slide slit 19 left therebetween to form a through aperture;

(b) a large steel hanger bolt 17 with a threaded portion passes through said slide slit 19 and is fixed to said steel backing member 18 by means of nuts 20;

(c) a first nut 20 is set at the lower end of said hanger bolt 17 passing through said slide slit, and other nut 20 is set at a position above and slightly spaced part from said first nut 20, thereby enabling level adjustment;

(d) an elongated steel ceiling system bar 1 is secured to said hanger bolt 17 by inserting a second nut 20 set at the end of said hanger bolt 17 into a large aperture 12 opened in an upper raised portion 10 formed on said ceiling system bar 1, where sliding said second nut 20 is slid along the edge of an elongated aperture 13 while making said hanger bolt 17 vertical and turning said another one of said nuts 20 to fix said ceiling system bar 1 to said hanger bolt 17, said ceiling system bar 1 having a hollow inner space with downward facing opening and a substantially rectangular cross-sectional configuration, said ceiling system bar 1 having, at free ends of its opposite side wall portions, support projections 5 projecting therefrom outwardly and perpendicularly to a small extent, said ceiling system bar 1 having a pair of elongated F-shaped frame projections each having a F-shaped cross-sectional configuration in a rectangular form with a short leg portion, said configuration being outwardly and perpendicularly extending from the free ends of said support projections 5 such as to form a symmetrical arrangement, and each having a first recess 7 facing outwardly and formed in a position corresponding to the upper portion of said F-shaped configuration and a second recess 8 formed thereunder, said recesses being fully charged with airtight material 23, said ceiling system bar 1 having elongated engaging walls 9 extending upwardly and vertically to a small extent from said opposite side wall portions corresponding left and right sides of said rectangular cross-sectional configuration, said ceiling system bar 1 having said upper raised portion 10 in a form of an elongated rectangular box-like projection upwardly projecting from a portion corresponding to a bottom side of said rectangular cross-sectional configuration to a level corresponding to a height of said engaging walls 9, and said ceiling system bar 1 further having rectangular fitting channels 11 formed between said engaging walls 9 and said upper raised portion 10, elongated slanted walls 14 formed by slightly slantingly cutting and removing inner edges of said downward facing opening and inner wall portions equal to a small extent in a widthwise direction, elongated semi-circular grooves 15 having a semi-circular cross-sectional shape formed by cutting inner wall portions inside said slanted walls 14, and frame receiving portions 16 formed at further inner positions such as to extend therefrom inwardly and perpendicularly to a small extent;

(e) a ceiling panel 21 encircled by a steel plate is slantingly lifted upwardly between said ceiling system bars while one of the opposite sides of said ceiling panel 21 is being positioned above the other, and is engaged with and hooked on said ceiling system bars 1 while being leveled, said ceiling panel 21 being charged with a reinforcement member, a heat insulating or sound insulating material 28, and said ceiling panel 21 having hook frames 22 having a cross-sectional configuration in a form of rectangular hooks symmetrical in the vertical direction formed by inwardly turning said steel plate, which forms a panel surface 29, over the full width of said panel along the opposite ends surfaces thereof which contact said ceiling system bars 1 and thereafter outwardly turning said steel plate;

(f) said hook frames 22 are engaged with and hooked on said F-shaped frame projections 6 without leaving any gap therebetween, and a ceiling cover 24 is fitted into said downward facing opening of said ceiling system bar 1 such as to align said panel surface 29 with a decorative surface 27 of said ceiling cover 24, said ceiling cover 24 in the form of an elongated member made of metal having a generally U-shaped cross-sectional configuration, said ceiling cover 24 having insertion extensions 25 corresponding to the opposite sides of said U-shaped cross-sectional configuration, said insertion extensions 25 being fitted into said downward facing opening of said ceiling system bar 1, said ceiling cover 24 having elongated semi-circular protrusions 26 having a semi-circular cross-sectional shape formed on the outer surfaces of said insertion extensions 25 at the free ends thereof to extend outwardly, said semi-circular protrusions 26 outwardly being brought into contact with said semi-circular grooves 15 of said ceiling system bar 1 in the outward directions at a time of fitting, and said ceiling cover 24 having said decorative surface 27 having a width equal to a distance between outer surfaces of said pair of F-shaped frame projections 6 and formed by perpendicularly and outwardly extending the portion corresponding to the bottom side of said U-shaped cross-sectional configuration over an entire length of said ceiling cover 24;

(g) aluminium members 2 in the form of elongated frame members made of soft metal such as aluminium are laterally disposed on the reverse side of the ceiling above said ceiling panel 21 such as to be perpendicular to said ceiling system bars 1 and are thereafter fixed to form an accommodation frame 3; and (h) said ceiling system bar 1 and said ceiling panel 21 are connected to each other by fitting a panel holder 30 in a form of an elongated member made of metal from the reverse side of the ceiling onto said ceiling system bar 1 and said ceiling panel 21, said panel holder 30 having a panel holding extension 31 narrowly formed by inwardly and perpendicularly bending a free end of one of left and right side wall portions corresponding to a generally U-shaped cross-sectional configuration of said panel holder 30, said panel holder 30 further having a first fitting extension 32 corresponding to the other side wall portion, an upper holding extension 33 outwardly projecting perpendicularly from the outer surface of said fitting extension 32 to a small extent at a position spaced apart from a free end of said fitting extension 32 and at a distance corresponding to a height of said upper raised portion 10, an elongated second fitting extendion 34 perpendicularly extending from a inner surface of said panel holder corresponding to the bottom side of said U-shaped cross-sectional configuration to a slightly smaller extent than a height of said fitting extension 32, said first fitting extension 32 and said second fitting extension 34 being fitted into said fitting channel 11 of said ceiling system bar 1, said upper holding extension 33 being brought into contact with said upper raised portion 10, and said panel holding extension 31 being brought into contact with said panel surface 29 of said ceiling panel 21, (II) said floor device is characterized in that:

(a) a floor system bar 40 is disposed on a support foot 43 and embedded in a floor such as to be upwardly open and face one of said ceiling system bars 1, said floor system bar 40 having elongated receiving projections 41 inwardly and perpendicularly extending from inner surfaces of said wall portions of said floor system bar 40 at positions generally corresponding to centers of opposite sides of a U-shaped configuration to an extent about one third a distance between said inner surfaces, said floor system bar 40 having semi-circular grooves 15 having a semi-circular cross-sectional shape and formed in the inner surface of said side wall portions in positions immediately above those of said receiving projections 41 over an entire length of said floor system bar, said floor system bar 40 having lips 42 formed by perpendicularly and outwardly extending the free ends of said side wall portions to a small extent, a floor surface 44 and surfaces of said lips 42 being aligned with each other, the distance between the opposite inner surfaces of said floor system bar at an opening thereof being equal to that between the inner surfaces of frame extensions 36 of a ceiling frame 35 which is described later; and (b) a floor cover 45 is fitted into said floor system bar 40, said floor cover 45 in a form of an elongated thin metal frame member having a generally U-shaped cross-sectional configuration with an opening downward facing, said floor cover 45 having elongated semi-circular protrusions 26 having a semi-circular cross-sectional shape and formed on an outer surfaces of left and right side wall portions of said floor cover at free ends thereof, said semi-circular protrusions 26 being fittingly brought into contact with said semi-circular grooves 15 of said floor system bar 40 in an outward directions, a floor cover surface 46 being alinged with the surfaces of said lips 42 and said floor surface 44, (III) said ceiling cover 24 fitted and fixed in said ceiling system bar 1, said ceiling frame 35 is fitted and fixed to said downward facing opening thereof without leaving any gap, providing a lighting fixture 39 in said ceiling frame 35 without leaving any gap therebetween, said ceiling frame 35 in the form of an elongated metal member having a generally U-shaped cross-sectional configuration with an opening facing downwardly, said ceiling frame 35 having said frame extensions 36 corresponding to opposite sides of said U-shaped cross-sectional configuration, and elongated semi-circular protrusions 26 having a semi-circular cross-sectional shape and formed on its outer surfaces, said elongated semi-circular protrusions being brought into contact with said semi-circular grooves 15 of said ceiling system bar 1 in an outward directions at a time of fitting, a bottom frame portion 37 of the ceiling frame 35 corresponding to a bottom side of said U-shaped cross-sectional configuration and being brought into contact with said support projections 5 at the same time, said ceiling frame 35 further having joint cover extensions 38 formed by outwardly and perpendicularly extending a free ends of said frame extensions 36 to a position which corresponds to the outer surfaces of said F-shaped frame projections 6 at the time of fitting, open front surfaces of said joint cover extensions 38 being aligned with said panel surface 29 at the same time while reverse surfaces of said joint cover extensions 38 are brought into contact with said short leg portions of said F-shaped frame extensions, and (IIII) said partition device is characterized in that:

(a) after said ceiling frame 35 has been mounted in said ceiling system bar 1 and after said floor cover 45 in a corresponding position and has been removed from said floor system bar 40, an upper end of a partition wall 47 is inserted into said frame extensions 36, moved downwardly while being maintained to be vertical to fit a lower end of said floor system bar 40, and brought into contact at the lower end with said receiving projections 41, a thickness of said partition walls 47 being set to be equal to a distance between inner surfaces of said frame extensions 36;

(b) and, a lower attachment fixture 49 is set between said receiving projections 41 of said floor system bar 40 with gaps equal to a thickness of frame members being left between said lower attachment fixture 49 and said lips 42, and a door frame 48 having a thickness equal to that of said partition wall 47 is fitted and installed in an equivalent manner with regard to said partion wall 47.

* * * * *